US006098036A

United States Patent [19]

Zinser, Jr. et al.

[11] Patent Number: 6,098,036

[45] Date of Patent: Aug. 1, 2000

[54] SPEECH CODING SYSTEM AND METHOD INCLUDING SPECTRAL FORMANT ENHANCER

[75] Inventors: Richard Louis Zinser, Jr., Niskayuna; Mark Lewis Grabb, Ballston Spa; Glen William Brooksby, Scotia; Steven Robert Koch, Niskayuna, all of N.Y.

[73] Assignee: Lockheed Martin Corp., King of Prussia, Pa.

[21] Appl. No.: 09/114,664

[22] Filed: Jul. 13, 1998

[51] Int. Cl.[7] ..... G10L 19/04

[52] U.S. Cl. ..... 704/219; 704/206

[58] Field of Search ..... 704/205, 206, 704/209, 219

[56] References Cited

U.S. PATENT DOCUMENTS

| | | | |
|---|---|---|---|
| 5,241,650 | 8/1993 | Gerson et al. | 704/205 |
| 5,479,560 | 12/1995 | Mekata | 704/209 |

OTHER PUBLICATIONS

Hong Kook Kim, Yong Duk Cho, Moo Young Kim, and Sang Ryong Kim, "A 4 Kbit/s Renewal Code Excited Linear Prediction Speech Coder," Proc. IEEE ICASSP '97, vol. 2, p. 767–770, Apr. 1997.

Roar Hagen, W. Bastiaan Kleijn, and Erik Ekudden, "Relaxing Model–Imposed Constraints Based on Decoder Analysis," Proc. 1997 IEEE Workshop on Speech Coding for Telecommunications, p. 59–60, Sep. 1997.

Juin–Hwey Chen and Allen Gersho, "Adaptive Postfiltering for Quality Enhancement of Coded Speech," IEEE Trans. Speech and Audio Processing, Vojl. 3, No. 1, p. 59–71, Jan. 1995.

"Digital Processing of Speech Signals," LR Rabiner, RW Schafer, 1978, pp. 411–412.

"A Fixed–Point Computation of Partial Correlation Coefficients," J. LeRoux, C. Guegen, IEEE Transactions on ASSP, 1977, vol. 25, pp. 257–259.

"Improving Performance of Multi–Pulse LPC Coders at Low Bit Rates," S. Isinghas, B. Atal, IEEE ICASSP, May 1984, pp. 1.3.1–1.3.5.

"Line Spectrum Representation of Linear Predictive Coefficients of Speech Signals," J. Acoustic Society of America, 1975, vol. 57, p. 353.

"Efficient Vector Quantization of LPC Parameters at 24 Bits/frame," KK Paliwal, S Atal, IEEE Transactions on Speech and Audio Processing, Jan. 1993, vol. TSAP–1, pp. 661–664.

"Inmarsat–M System Definition Manual: Appendix I: Voice Coding System," Digital Voice Systems, Inc., Aug. 1991.

"The Sinusoidal Transform Coder at 2400 b/s," RJ McAulay, TF Quaieri, IEEE ICASSP, 15.6.1–15.6.3.

"High–Quality Harmonic Coding at Very Low Bit Rates," G. Yang, H. Leich, IEEE ICASSP, 1994, pp. I–181–I–184.

*Primary Examiner*—David R. Hudspeth
*Assistant Examiner*—Tālivaldis Ivars Šmits
*Attorney, Agent, or Firm*—C. Johnson; W. Meise

[57] ABSTRACT

A speech coding system and associated method rely on a speech encoder and a speech decoder. The speech decoder includes a Linear Predictive Coding (LPC) filter having an input and an output. The LPC filter provides synthesized speech at the output in response to voiced and unvoiced excitation provided at the input. A harmonic generator for providing voiced excitation to the input of the LPC filter includes a spectral formant enhancer for attenuating the amplitude of harmonics generate by the harmonic generator in spectral valleys between format peaks of respective frames of voiced speech. The system and method reduce perceived buzziness while increasing perceived spectral depth of synthesized speech at the output of the LPC filter.

2 Claims, 7 Drawing Sheets

SPEECH CODING SYSTEM AND METHOD INCLUDING SPECTRAL FORMANT ENHANCER

RELATED APPLICATIONS

This application is related to application Ser. Nos. 09/114,661; 09/114,660; 09/114,659; and allowed application Ser. Nos. 09/114,658; 09/114,663; and 09/114,662.

BACKGROUND OF THE INVENTION

1. Field of the Invention

The present invention relates to speech coders and speech coding methods, and more particularly to a linear prediction based speech coder system and associated method for providing low bit rate speech representation and high quality synthesized speech.

2. Discussion of the Prior Art

The term speech coding refers to the process of compressing and decompressing human speech. Likewise, a speech coder is an apparatus for compressing (also referred to herein as coding) and decompressing (also referred to herein as decoding) human speech. Storage and transmission of human speech by digital techniques has become widespread. Generally, digital storage and transmission of speech signals is accomplished by generating a digital representation of the speech signal and then storing the representation in memory, or transmitting the representation to a receiving device for synthesis of the original speech.

Digital compression techniques are commonly employed to yield compact digital representations of the original signals. Information represented in compressed digital form is more efficiently transmitted and stored and is easier to process. Consequently, modern communication technologies such as mobile satellite telephony, digital cellular telephony, land-mobile telephony, Internet telephony, speech mailboxes, and landline telephony make extensive use of digital speech compression techniques to transmit speech information under circumstances of limited bandwidth.

A variety of speech coding techniques exist for compressing and decompressing speech signals for efficient digital storage and transmission. It is the aim of each of these techniques to provide maximum economy in storage and transmission while preserving as much of the perceptual quality of the speech as is desirable for a given application.

Compression is typically accomplished by extracting parameters of successive sample sets, also referred to herein as "frames", of the original speech waveform and representing the extracted parameters as a digital signal. The digital signal may then be transmitted, stored or otherwise provided to a device capable of utilizing it. Decompression is typically accomplished by decoding the transmitted or stored digital signal. In decoding the signal, the encoded versions of extracted parameters for each frame are utilized to reconstruct an approximation of the original speech waveform that preserves as much of the perceptual quality of the original speech as possible.

Coders which perform compression and decompression functions by extracting parameters of the original speech are generally referred to as parametric coders. Instead of transmitting efficiently encoded samples of the original speech waveform itself, parametric coders map speech signals onto a mathematical model of the human vocal tract. The excitation of the vocal tract may be modeled as either a periodic pulse train (for voiced speech), or a white random number sequence (for unvoiced speech). The term "voiced" speech refers to speech sounds generally produced by vibration or oscillation of the human vocal cords. The term "unvoiced" speech refers to speech sounds generated by forming a constriction at some point in the vocal tract, typically near the end of the vocal tract at the mouth, and forcing air through the constriction at a sufficient velocity to produce turbulence. Speech coders which employ parametric algorithms to map and model human speech are commonly referred to as "vocoders."

Over the years numerous successful parametric speech coding techniques have been based on linear prediction coding (LPC). LPC vocoders employ linear predictive (LP) synthesis filters to model the vocal tract. An LP synthesis filter is a filter which predicts the value of the next speech sample based on a linear combination of previous speech samples. The coefficients of the LP synthesis filter represent extracted parameters of the original speech sound. The filter coefficients are estimated on a frame-by-frame basis by applying LP analysis techniques to original speech samples. These coefficients model the acoustic effect of the mouth above the vocal cords as words are formed.

A typical vocoder system comprises an encoder component for analyzing, extracting and transmitting model parameters, and a decoder component for receiving the model parameters and applying the received parameters to an identical mathematical model. The identical mathematical model is used to generate synthesized speech. Synthesized speech is an imitation, or reconstruction, of the original input speech. In a typical vocoder system speech is modeled by parametizing four general characteristics of the input speech waveform. The first of these is the gross spectral shape of the input waveform. Spectral characteristics of the speech are represented as the coefficients of the LP synthesis filter. Other typically parametized characteristics are signal power (or gain), voicing (an indication of whether the speech is voiced or unvoiced), and pitch of voiced speech.

The decoder component of a vocoder typically includes the linear prediction (LP) synthesis filter. Either a periodic pulse train for voiced speech, or a white random number sequence for unvoiced speech, provides the excitation for the LP synthesis filter.

Many existing vocoder systems suffer from poor perceptual quality in the synthesized speech. Insufficient characterization of input speech parameters, bandwidth limitations and subsequent generation of synthesized speech from encoded digital representations all contribute to perceptual degradation of synthesized speech. In particular, the performance of linear prediction based vocoders suffers from the limitations imposed by current techniques in representing the voicing characteristic. Virtually all prior art vocoder techniques employ a binary decision making process to represent a frame of speech, or frequency bands within a frame, as either voiced or unvoiced. This type of binary voicing decision results in decreased performance, especially for speech frames where both periodic and noisy frequency bands are present.

Accordingly, a need exists for a speech encoder and method for rapidly, efficiently and accurately characterizing speech signals in a fashion lending itself to compact digital representation thereof. Further, a need exists for a speech decoder and method for providing high quality speech signals from the compact digital representations. The problem of providing high fidelity speech while conserving digital bandwidth and minimizing both computation complexity and power requirements has been long standing in the art.

SUMMARY OF THE INVENTION

In an exemplary embodiment of the invention a speech coding system comprises an encoder subsystem for encoding speech and a decoder subsystem for decoding the encoded speech and producing synthesized speech therefrom. The system may further include memory for storing encoded speech or a transmitter for transmitting encoded speech from the encoder subsystem, or memory, to the decoder subsystem. The encoder subsystem of the present invention includes, as major components, an LPC analyzer, a gain analyzer, a pitch analyzer and a voicing cut off frequency analyzer. The voicing cut off frequency analyzer comprises a voicing cut off frequency estimator for estimating a voicing cut off frequency for each frame of speech analyzed, and a voicing cut off frequency quantizer for representing the estimated voicing cut off frequency in compressed digital form, i.e., as a voicing cut off frequency index signal.

The decoder subsystem of the present invention includes, as major components, an LPC decoder, a gain decoder, a pitch decoder and a voicing cut off frequency decoder. The voicing cut off frequency decoder is adapted to receive the voicing cut off frequency index signal and to determine the corresponding estimated voicing cut off frequency—the frequency below which a frame of speech is voiced and above which a frame of speech is unvoiced. The voicing cut off frequency is provided to a harmonic generator, or to other decoder components, adapted to utilize the voice cut off frequency such that the perceptual buzziness of speech is reduced.

An exemplary embodiment of the method of the present invention comprises the steps of obtaining at least one frame of speech to be coded, estimating a voicing cut-off frequency for the at least one frame, representing the estimated voicing cut-off frequency by means of a voicing cut off frequency index (fsel), and providing the voicing cut off frequency index signal to a device adapted to utilize it.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like numbers represent like parts throughout the drawings, and in which:

DETAILED DESCRIPTION OF THE INVENTION

Overview

Figure 1:
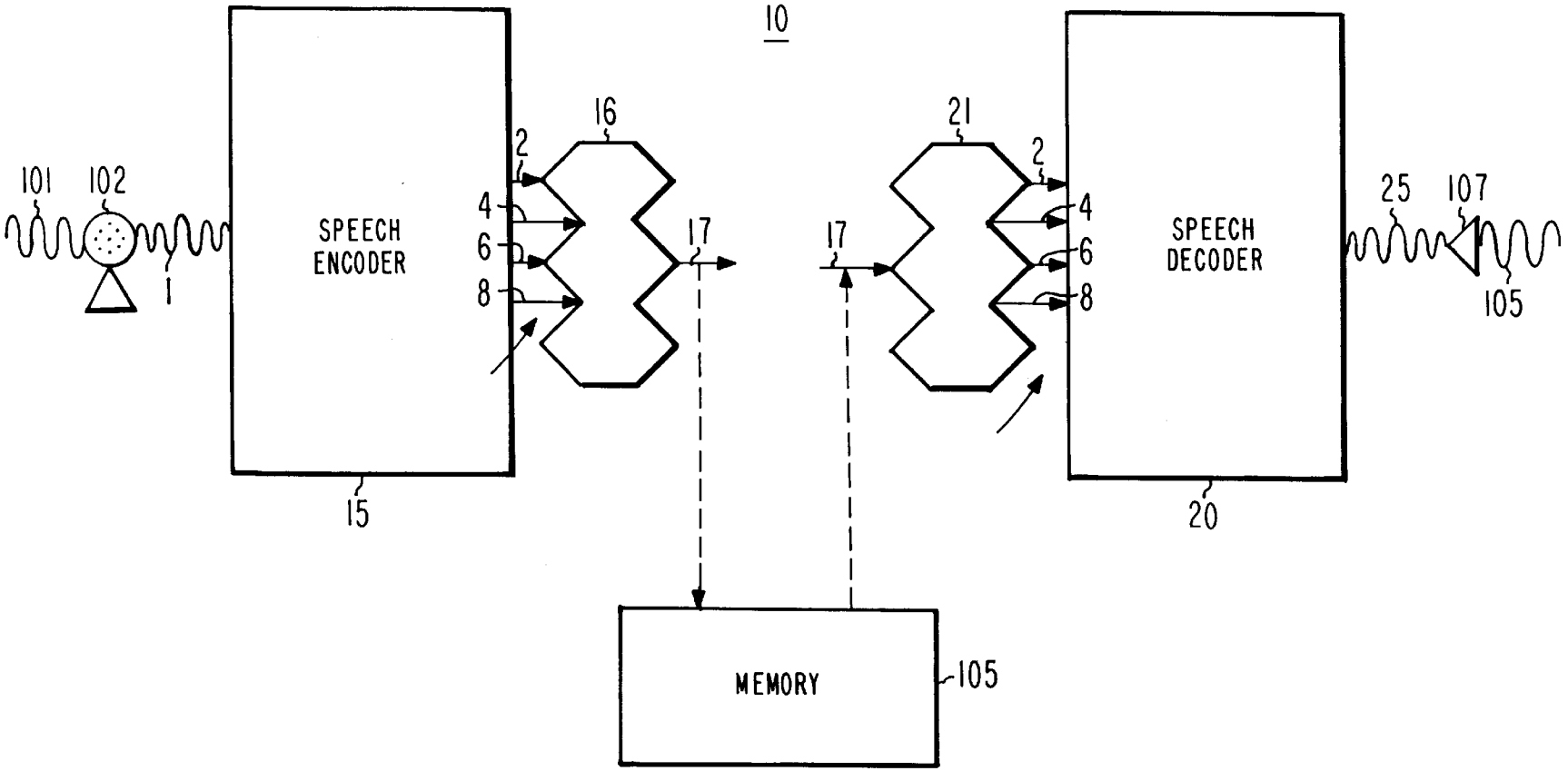
FIG. 1 is a block diagram of a speech coding system according to one embodiment of the present invention.

A speech coding system 10 in accordance with a primary embodiment of the present invention comprises two major subsystems: speech encoder subsystem 15, and speech decoder subsystem 20, as illustrated in FIG. 1. The basic operation of speech coder 10 is as follows. An input device 102, such as a microphone, receives an acoustic speech signal 101 and converts the acoustic speech signal 101 to an electrical speech signal 1. In the present disclosure the term "speech" includes voice, speech and other sounds produced by humans. Input device 102 provides the electrical speech signal as speech input signal 1 to speech encoder 15. Speech input signal 1, therefore, comprises analog waveforms corresponding to human speech. Speech encoder 15 converts speech input signal 1 to a digital speech signal, operates upon the digital speech signal and provides compressed digital speech signal 17 at its output.

Compressed digital speech signal 17 may then be stored in memory 105. Memory 105 can comprise solid state memory, magnetic memory such as disk or tape, or any other form of memory suitable for storage of digitized information. In addition, compressed digital speech signal 17 can be transmitted through the air to a remote receiver, as is commonly accomplished by radio frequency transmission, microwave or other electromagnetic energy transmission means known in the art.

When it is desired to recreate speech input signal 1 for a listener, or for other purposes, compressed digital speech signal 17 may be retrieved from memory, transmitted, or otherwise provided to speech decoder 20. Speech decoder 20 receives compressed digital speech signal 17, decompresses it, and converts it to an analog speech signal 25 provided at its output. Analog speech signal 25 is a reconstruction of speech input signal 1. Analog speech signal 25 may then be converted to an acoustic speech signal 105 by an output device such as speaker 107. Ideally, acoustic speech signal 105 will be perceived by the human ear as identical to acoustic speech signal 101.

The term quality, as it relates to synthesized speech, refers to how closely acoustic speech signal 105 is perceived by the human ear to match the original acoustic speech 101. The quality of synthesized speech signal 25 is directly related to the techniques employed to encode and decode speech input signal 1. FIG. 1 will now be explained in more detail with emphasis on the system and method of the present invention.

Speech encoder 15 samples speech input signal 1 at a desired sampling rate and converts the samples into digital speech data. The digital speech data comprises a plurality of respective frames, each frame comprising a plurality of samples of speech input signal 1. Speech encoder 15 analyzes respective frames to extract a plurality of parameters which will represent speech input signal 1. The extracted parameters are then quantized. Quantization is a process in which the range of possible values of a parameter is divided into non overlapping (but not necessarily equal) sub ranges. A unique value is assigned to each sub range. If a sample of the signal falls within a given sub range, the sample is assigned the corresponding unique value (referred to herein as the quantized value) for that sub range. A quantization index may be assigned to each quantized value to provide a reference, or a "look up" number for each quantized value. A quantization index may, therefore, comprise a compressed digital signal which efficiently represents some parameter of the sample.

In accordance with one embodiment of the present invention, four quantization indices are generated by speech encoder 15: an LSF index signal 2, a gain index signal 4, a pitch index signal 8, and a voicing cut off frequency index signal 6. Speech encoder 15 generates LSF index signal 2 by performing an intermediate step of first generating a plurality of LPC coefficients corresponding to a model of the human vocal tract. Speech encoder 15 then converts the LPC coefficients to Line Spectral Frequencies and provides these as LSF index signal 2. Therefore, LSF index signal 2 is derived from LPC coefficients. Each of the quantized digital signals is a highly compressed digital representation of some characteristic of the input speech waveform. Each of the quantized digital signals may be provided separately to a multiplexer 16 for conversion into a combined signal 17 which contains all of the quantized digital signals. Depending on the desired application, the quantization indices, or combined signal 17, or any portion thereof, may be stored in memory for subsequent retrieval and decoding. Alternatively, combined signal 17, or any portion thereof, may be utilized to modulate a carrier for transmission of the quantization indices to a remote location. After reception at the remote location, combined signal 17 may be decoded, and a reproduction, or synthesis, of speech input signal 1 may be generated by applying the quantization indices to a model of the human vocal tract.

One embodiment of the present invention includes a speech decoder 20 as shown in FIG. 1. Decoder 20 is utilized to synthesize speech from combined signal 17. The configuration of speech decoder 20 is essentially the same whether combined signal 17 is retrieved from memory for synthesis, or transmitted to a remote location for synthesis. If combined signal 17 is transmitted to a remote location, reception and carrier demodulation must be performed in accordance with well known signal reception methods to recover combined signal 17 from the transmitted signal. Once recovered, or retrieved from memory, combined signal 17 is provided to demultiplexer 21. Demultiplexer 21 demultiplexes combined signal 17 to separate LSF index signal 2, gain index signal 4, voicing cut off frequency index signal 6 and pitch index signal 8.

Speech decoder 20 may receive each of these indices simultaneously once for each frame of digital speech data encoded by speech encoder 15. Speech decoder 20 decodes the indices and applies them to an LP synthesis filter (not shown) to produce synthesized speech signal 25.

Speech coding systems according to the present invention can be used in various applications, including mobile satellite telephones, digital cellular telephones, land-mobile telephones, Internet telephones, digital answering machines, digital voice mail systems, digital voice recorders, call servers, and other applications which require storage and retrieval of digital voice data.

When used in speech coding applications such as digital telephone answering machines, speech encoder 15 and speech decoder 20 may be co-located within a single housing. Alternatively, when speech coding system 10 is used in applications requiring transmission of the coded speech signal for reception and synthesis at a remote location, speech encoder 15 may be remotely located from speech decoder 20.

Figure 2:
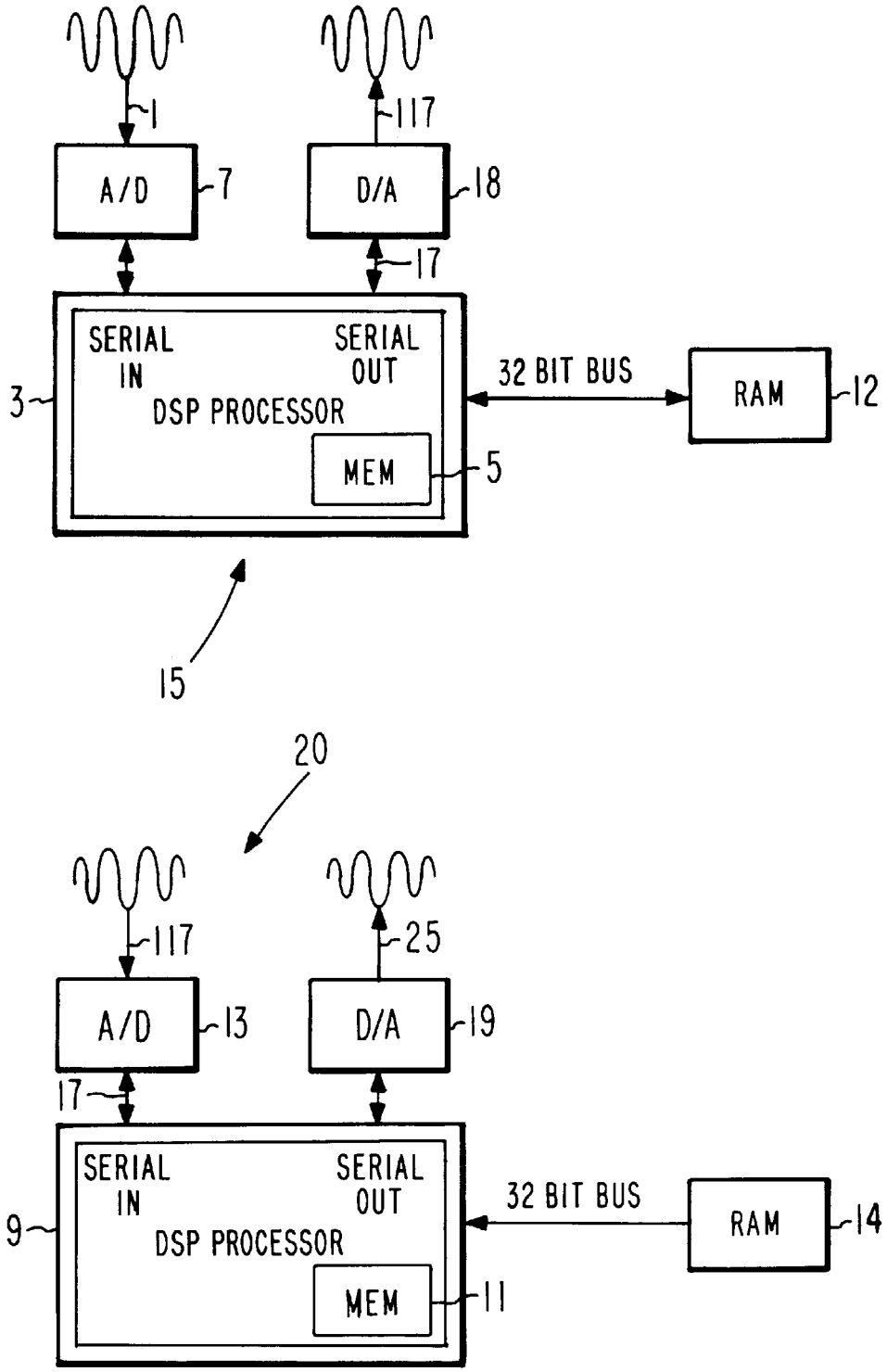
FIG. 2 is a hardware block diagram of a speech coding system according to one embodiment of the present invention.

FIG. 2 is a hardware block diagram illustrating a configuration for implementation of the voice coding system and method of the present invention. As illustrated in FIG. 2 speech encoder 15 and speech decoder 20 may include one or more digital signal processors (DSP). One embodiment of the present invention includes two DSPs: a first DSP 3 and a second DSP 9. First DSP 3 includes a first DSP local memory 5. Likewise, second DSP 9 includes a second DSP local memory 11. First and second DSP memory 5 and 11 serve as analysis memory used by first and second DSPs 3 and 9 in performing speech encoding and decoding functions such as speech compression and decompression, as well as parameter data smoothing.

First DSP 3 is coupled to a first parameter storage memory 12. Likewise, second DSP 9 is coupled to a second parameter storage memory 14. First and second parameter storage memory 12 and 14 store coded speech parameters corresponding to a received speech input signal 1. In one embodiment of the present invention, first and second storage memory 12 and 14 are low cost dynamic random access memory (DRAM). However, it is noted that first and second storage memory 12 and 14 may comprise other storage media, such as magnetic disk, flash memory, or other suitable storage media. In one embodiment of the present invention, speech coding system 10 stores data in 16 bit values. However, speech coding system 10 may store data in other bit quantities, such as 32 bits, 64 bits, or 8 bits, as desired.

In an alternative embodiment of the present invention a Central Processing Unit (CPU) (not shown) may be coupled to speech encoder 15 and speech decoder 20 to control operations of speech encoder 15 and speech decoder 20, including operations of first and second DSPs 3 and 9 and first and second DSP memory 5 and 11. One or more CPUs may also perform memory management functions for speech coding system 10 and first and second storage memory 12 and 14 according to techniques well known in the art.

As shown in FIG. 2, speech input signal 1 enters speech coding system 10 via a microphone, tape storage, or other input device (not shown). A first analog to digital (A/D) converter 7 samples and quantizes speech input signal 1 at a desired sampling rate to produce digital speech data. The rate at which speech input signal 1 is sampled is an indication of the degree of compression achieved by speech coding system 10. The term "uncompressed bit rate", as defined herein, refers to the product of the rate at which speech input signal 1 is sampled and the number of bits per sample.

In one embodiment of the present invention, speech input signal 1 is sampled at a rate of 8 Kilohertz (kHz), or 8000 samples per second. In an alternate embodiment the sampling rate may be the Nyquist sampling rate. Other sampling rates may be used as desired. After sampling, the speech signal waveform is quantized into digital values using one of a number of suitable quantization methods. First DSP 3 stores the digital values in first DSP memory 5 for analysis.

While additional speech data is being received, sampled, quantized and stored locally in first DSP memory 5, first DSP 3 encodes the speech data into a number of parameters for storage. In this manner, first DSP 3 generates a parametric representation of the data. To accomplish the coding of spectral parameters, first DSP employs linear predictive coding algorithms well known in the art. In addition, according to the teachings of the present invention, first DSP 3 is adapted to efficiently represent a voicing cut off frequency parameter.

As previously stated, first DSP 3 performs encoding on frames of the digital speech data to derive a set of parameters which describe the speech content of the respective frames being examined. In one embodiment of the present invention linear predictive coding is performed on groupings of four frames. However, it is noted that a greater or lesser number of frames may be encoded at a time, as desired.

In one embodiment of the present invention first DSP 3 examines the speech signal waveform in 20 ms frames for analysis and encoding into respective parameters. With a sampling rate of 8 kHz, each 20 millisecond (ms) frame comprises 160 samples of data. First DSP 3 examines one 20 ms frame at a time. However, each frame being examined may overlap neighboring frames by one or more samples on either side. In one embodiment of the present invention, first DSP memory 5 is sufficiently large to store up to at least about four full frames of digital speech data. This allows first DSP 3 to examine a grouping of three frames while an additional frame is received, sampled, quantized and stored in first DSP memory 5. First DSP memory 5 may be configured as a circular buffer where newly received digital speech data overwrites speech data from which parameters have already been generated and stored in the storage memory.

First DSP 3 generates a plurality of LPC coefficients for each frame it analyzes. In one embodiment of the present invention, 10 LPC coefficients are generated for each frame. In addition to generating LPC coefficients, first DSP 3 generates compressed signals representing other parameters of the speech signal. As previously stated herein, these include pitch index signal 8, voicing cut off frequency index signal 6, and gain index signal 4. First DSP 3 provides each of these compressed digital signals as serial bit stream 17 to digital to analog converter 18. In one embodiment of the present invention, first digital to analog converter 18 employs compressed digital signal 17 to modulate a carrier, thereby producing an analog signal 117 which is in a form suitable for transmission by known radio frequency (RF) transmission methods to a remotely located receiver for reception and decoding.

A remotely located receiver comprising speech decoder 20 includes an analog to digital converter 13. Analog to digital converter 13 receives modulated analog signal 117 and demodulates the signal according to known demodulation techniques. In addition, analog to digital converter 13 converts the analog signal to a digital signal 17, in essence recovering the compressed digital signals generated by DSP 3 to representing speech input signal 1. Analog to digital converter 13 provides the compressed digital signals to DSP 9. DSP 9 decodes the information contained in the compressed digital signals to provide a digital representation of speech input signal 1. DSP 9 provides the digital representation to a second digital to analog converter 19 which utilizes it to recreate, or synthesize, speech input signal 1 thereby producing synthesized speech signal 25.

As will be readily apparent to those skilled in the art, if speech encoder 15 and speech decoder 20 are co-located within a single housing, a single CPU, DSP and shared memory may be employed to implement the functions of both speech encoder 15 and speech decoder 20.

Speech encoder

Figure 3:
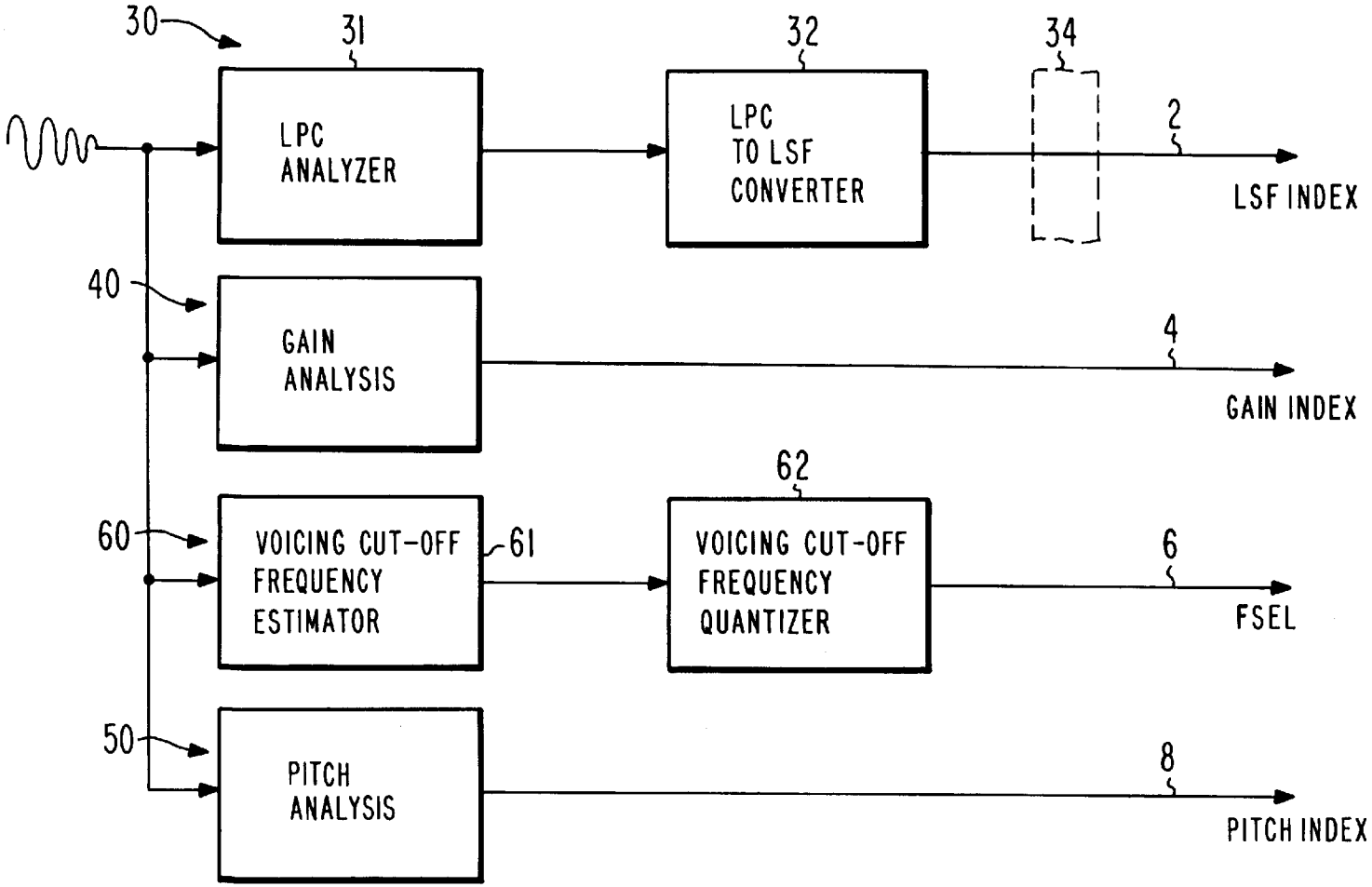
FIG. 3 is a block diagram of the encoder subsystem of the speech coding system illustrated in FIG. 1.

Turning now to FIG. 3 there is shown a block diagram of speech encoder 15. Speech encoder 15 comprises four major components: spectral analyzer 30; gain analyzer 40; pitch analyzer 50; and voicing cut off frequency analyzer 60.

Spectral analyzer 30, in turn, comprises as major components, LPC analyzer 31 and LPC to LSF converter 32. The main function of LPC analyzer 31 and LPC to LSF converter 32 is to determine the gross spectral shape of speech input signal 1 and to represent that spectral shape as quantized digital bits comprising LSF index signal 2. To accomplish this, LPC analyzer 31 determines LPC filter coefficients which, when applied to an LPC synthesis filter (shown in FIG. 5 at 90), will model the human speech spectrum so as to result in an output speech waveform having spectral characteristics similar to that of speech input signal 1. LPC analyzer 31 provides the LPC coefficients to LPC to LSF converter 32. LPC to LSF converter 32 converts the LPC coefficients to LSFs. The LSFs are then quantized and provided as LSF index signal 2 to multplexer 16.

Gain analyzer 40 determines the gain, or amplitude, of speech input signal 1, encodes and quantizes this gain information and provides the resulting gain index signal 4 to multiplexer 16 (shown in FIG. 1 at 16). Pitch analyzer 50 receives speech input signal 1, determines the pitch period and frequency characteristics of signal 1, encodes and quantizes this information and provides pitch index signal 8 to multiplexer 16.

Speech input signal 1 is also provided to voicing cut off frequency analyzer 60. Voicing cut off frequency analyzer 60 includes voicing cut off frequency estimator 61 and voicing cut off frequency quantizer 62. The apparatus and method embodying voicing cut off frequency analyzer 60 will now be explained in greater detail.

In general, each frame of digital data representing speech input signal 1 comprises either a voiced speech component or an unvoiced speech component, or both. Many prior art speech coding systems classify each frame as either voiced or unvoiced. However, many regions of natural speech display a combination of a both voiced and unvoiced speech components, i.e., a harmonic spectrum for voiced speech and a noise spectrum for unvoiced speech. Generally, if the spectrum contains both harmonic and noise components, the harmonic components are more prominent at the lower frequencies while the noise components are more prominent at the higher frequencies. Hence, a mixture of harmonic and noise components may appear over a large bandwidth.

Prior art speech coders which use simple voiced-unvoiced decisions to classify frames of speech samples often have difficulties when harmonic and noise components overlap in the time domain. When this overlap occurs, frames containing both voiced and unvoiced speech will be represented either as entirely voiced, or entirely unvoiced by prior art speech coding systems. To overcome this limitation, the present invention exploits the fact that harmonic and noise components, while possibly overlapping in the time domain, do not overlap in the frequency domain. Therefore, for each frame of digital speech data under analysis, a frequency is determined below which the excitation for that frame is voiced and above which the excitation for that frame is unvoiced. This frequency is referred to herein as the "voicing cut off frequency."

The most significant spectral components of human speech range in frequency from a lower limit of about 0 Hz to an upper limit of about 4000 Hz. Therefore, if a frame of speech is entirely voiced, all frequencies within the range of 0 Hz to 4000 Hz will be periodic. According to the teachings of the present invention, the voicing cut off frequency for such a frame would be represented as 4000 Hz. This is because no transition from periodic to random excitation is present between the lower frequency limit of 0 Hz and the upper frequency limit of 4000 Hz. In this case, the voicing cut off frequency is considered to be the upper frequency limit. Conversely, if a frame of speech is entirely unvoiced all frequencies between 0 Hz and 4000 Hz are aperiodic, or noise. Since all frequencies above 0 Hz are noise, the voicing cut off frequency is designated as 0 Hz.

For frames of speech data comprising both voiced and unvoiced excitation, the frequency above which the excitation is unvoiced and below which the excitation is voiced is determined, and quantized, on a frame by frame basis. For example, in a given frame, if all frequencies above about 300 Hz are noise and below about 300 Hz are periodic the voicing cut off frequency for that frame would be determined to be 300 Hz. The voicing cut off frequency, therefore, provides valuable information about the voicing characteristics of a given frame of speech. The voicing characteristics are information preserved, transmitted or otherwise utilized in synthesizing the speech.

In a system with an 8 kHz sampling rate, the voicing cut off frequency may take on values between 0 Hz (indicating a fully unvoiced signal) to 4000 Hz (indicating a fully voiced signal). In practice, the choice of voicing cutoff frequency is limited to the number of quantization levels assigned to transmit the voicing cut off frequency information. In one embodiment of the present invention, the voicing cut off index signal comprises 3 bits, also referred to herein as "voicing bits." Hence 8 quantization levels and 8 frequencies may be represented by the values 0 through 7. In one embodiment, the eight frequencies pre-selected to correspond to values 0 through 7 of the 3 voicing bits are equally spaced by 571 Hz and cover the spectrum from 0 to 4000 Hz. These frequencies are: 0, 571, 1143, 1714, 2286, 2857, 3249, and 4000 Hz (referred to herein as voicing cut off frequency values). Other numbers of equally spaced or unequally spaced frequencies may be employed to divide the spectrum into voicing cut off frequency values. The parameter fsel (Filter SELect), is used herein to denote the voicing index bits, in this case 3 bits which represent eight voicing cutoff frequency values.

Voicing cut off frequency estimator 61 is used to determine where, in the frequency spectrum, the transition from voiced to unvoiced excitation occurs. In one embodiment of the present invention, voicing cut off frequency estimator 61 comprises a seven band, bandpass filter bank. The filter bank is implemented with a 65 tap, finite impulse response (FIR) filter. Voicing cut off frequency estimator 61 provides 7 bandpass signals at its output. The 7 bandpass signals are provided to voicing cut off frequency quantizer 62. Voicing cut off frequency quantizer 62 determines the voicing cut off frequency based on the output of bandpass filter 61 and selects the voicing cut off frequency quantization level which includes the voicing cut off frequency of the frame of speech being analyzed. Voicing cut off frequency quantizer 62 then assigns a corresponding voicing cut off frequency index to represent the selected quantization level.

Detailed Description—Encoding

Spectral Analysis

Figure 4:
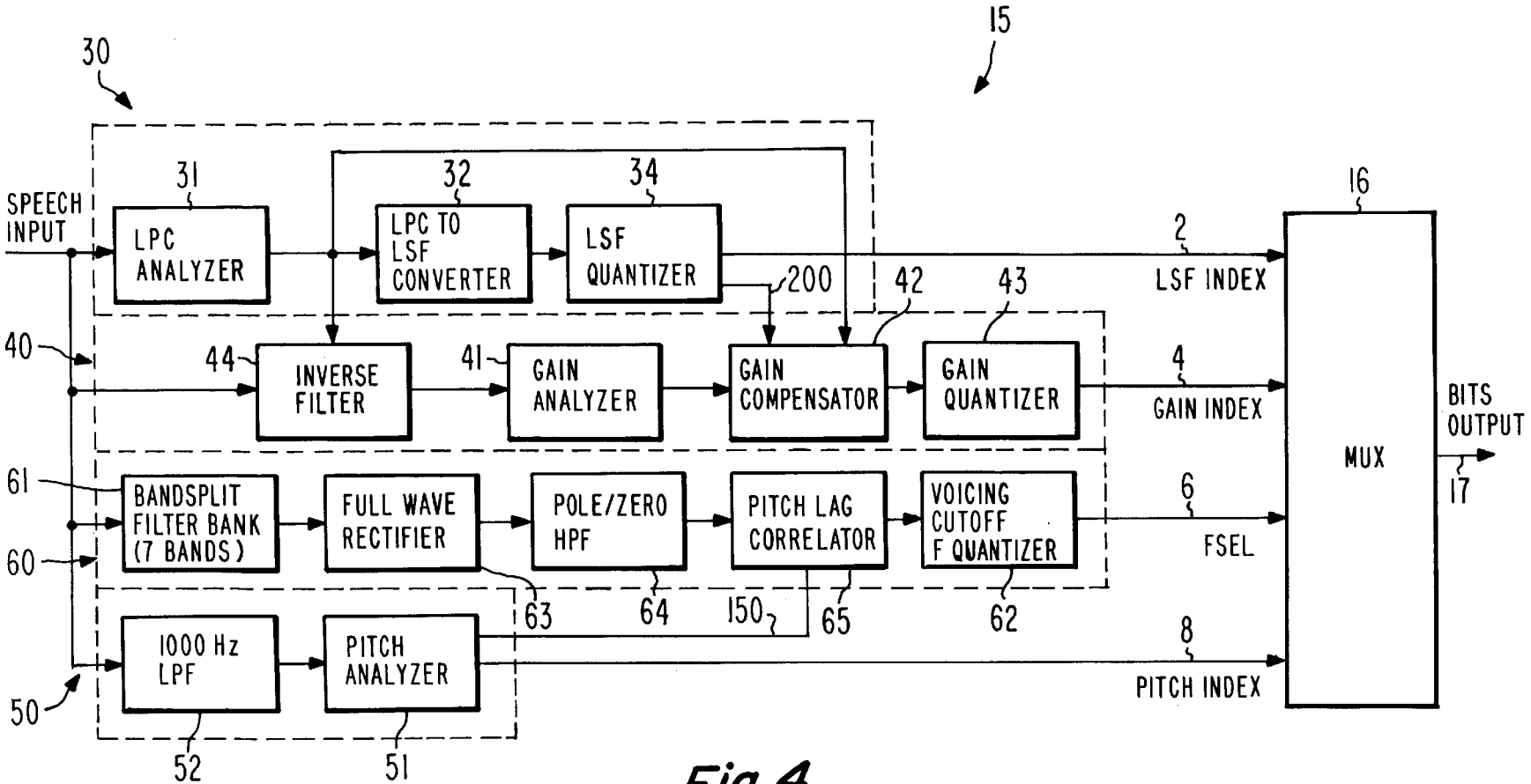
FIG. 4 is a detailed block diagram of the encoder subsystem of the speech coding system illustrated in FIG. 3.

Turning now to FIG. 4 there is shown a detailed block diagram of speech encoder 15, the components of which will now be discussed in greater detail. LPC analyzer 31 comprises a DSP (such as shown in FIG. 2 at 3), which may run any of several different algorithms for programs for performing LPC analysis known to those of ordinary skill in the art. For example, LPC analyzer 31 may employ autocorrelation-based techniques such as Durbin's recursion, or Leroux-Guegen techniques. Alternatively, known stabilized modified covariance techniques for LPC analysis may be employed. A tenth order LPC analysis is employed in one embodiment of the present invention. A tenth order analysis has been found to facilitate LSF vector quantization and to yield optimal results. However, other orders may be employed to obtain good results.

Accordingly, those of ordinary skill in the art will recognize that there exist many substitutions and variations of LPC analysis techniques suitable for use in the present invention. Though one embodiment of the present invention employs known modified stabilized covariance methods for LPC analyzer 31, the present invention is not intended to be restricted in scope to any particular method of LPC analysis.

LPC analyzer 31 provides 10 LPC coefficients to an LPC to LSF converter 32. As previously discussed, LPC to LSF converter 32 converts the 10 LPC coefficients to a Line Spectral Frequency signal, also referred to herein as line spectral pairs (LSPs). In one embodiment of the present invention, LPC to LSF converter 32 computes the LSP frequencies by known dissection methods, as described by F. K. Soong and B. H. Juang in "Line Spectrum Pair (LSP) and Speech Data Compression," Proc. ICASSP 84, pp. 1.10.1–1.10.4, hereby incorporated by reference. The basic technique is to generate two $5^{th}$ order (P&Q) polynomials from the $10^{th}$ order LPC polynomial, then find their roots. These are the LSP frequencies, or LSFs. The search for roots may be made more efficient by taking advantage of the fact that the roots are interlaced on the unit circle, with the first root belonging to P. The technique finds the zeros of P one at a time by evaluating the P polynomial over a grid of frequencies, looking for a sign change. When a sign change is detected, the root must lie between the two frequencies. It is then possible to refine the estimate of the root to the desired degree of accuracy. The technique then finds the zeros of Q one at a time, based on the fact that the first zero lies in the interval between the first 2 roots of P, the second zero lies in the interval between the $2^{nd}$ and $3^{rd}$ roots of P, and so on.

LPC to LSF converter 32 provides the LSF index signal to LSF quantizer 34. LSF quantizer 34 comprises a DSP (such as that shown in FIG. 2 at 3), which may employ any suitable quantization method. One embodiment of the present invention employs split vector quantization (SVQ) algorithms and techniques to quantize the LSFs. In an embodiment of the present invention operating at a bit rate of 2000 b/sec, a 20 msec frame size implementation uses a 26 bit SVQ algorithm to code the 10 LSFs into LSF index signal 2.

For quantization purposes, the 10 LSFs represented by LSF index signal 2, or vector, may be subdivided into subvectors, as follows: a first subvector comprising the first three LSFs, coded with 9 bits, a second subvector comprising the subsequent three LSFs, coded with 9 bits, and a third subvector comprising the last four LSFs, coded with 8 bits. The bit rate consumed for transmitting the spectrum is 26 bits/20 msec=1300 bits/sec.

An alternative embodiment of the present invention operates at 1500 b/sec and uses a 30 bit SVQ algorithm to code the LSFs for every other frame. For the SVQ coded frames, the 30 bits are split equally (10/10/10) among the 3 subvectors described above. The LSFs for frames not coded by the SVQ algorithm are instead linearly interpolated from adjacent frames (the previous frame and the next frame). An interpolation flag may be employed to indicate the weighting to be applied to the adjacent frames when generating the interpolated frame. In one embodiment of the present invention this flag uses two bits, with weight assignments as follows:

Interpolation Flag Weighting Table

| bit 1 | bit 2 | last frame weight ($W_L$) | future frame weight ($W_F$) |
|---|---|---|---|
| 0 | 0 | .875 | .125 |
| 0 | 1 | .625 | .375 |
| 1 | 0 | .375 | .625 |
| 1 | 1 | .125 | .875 |

The value of the interpolated frame LSFs is given by:

$$LSF_j(I)=w_L LSF_j(I-1)+w_F LSF_j(I+1)$$

where $LSF_j(i)$ is the j-th LSF for frame i.

The choice of interpolation flag setting is determined via analysis-by-synthesis techniques. All possible interpolated flag settings are generated and compared with the desired unquantized vector. The interpolated flag setting yielding the most desirable performance characteristics is selected for transmission. The desired performance characteristics may be based upon simple Euclidean distance, or upon frequency-weighted spectral distortion. The total bit rate consumed by this scheme is 30+2 bits/40 msec=800 bits/sec.

As those of ordinary skill in the art will recognize, various quantization techniques may be successfully employed to provide LSF index signal 2. Regardless of the quantization method, LSF quantizer 34 provides LSF index signal 2, representing the quantized values of the 10 LSFs, to multiplexer 16. LSF quantizer 34 also provides quantized LSF values to gain compensator 42.

Gain Analysis

As shown in FIG. 4, speech input signal 1 is provided to inverse filter 44. Also provided to inverse filter 44 are the 10 LPC coefficients generated by LPC analyzer 31. Using the speech input signal 1 and the LPC coefficients, inverse filter 44 generates an LPC residual signal by techniques well known to those of ordinary skill in the art. The residual signal is provided by inverse filter 44 to gain analyzer 41. Gain analyzer 41 calculates the root means square (RMS) value of the residual signal. In one embodiment of the present invention, gain analyzer 41 calculates the RMS value of the LPC residual according to the following formula:

$$RMS_{res} = \sqrt{\frac{1}{N}\sum_{i=1}^{N} r_i^2}$$

where $r_i$ are the residual samples and N is the number of samples in a frame (160 at 20 msec). The RMS residual is then provided to gain compensator 42.

In one embodiment of the present invention, gain compensator 42 receives the RMS residual from gain analyzer 41. Gain compensator 42 also receives the quantized LSF values generated by LSF quantizer 34. The quantized LPC gain is determined by converting the quantized LSF values to prediction coefficients, and then converting the prediction coefficients to a reflection coefficient. Gain compensator 42 compensates the gain by the ratio of the square root of the unquantized LPC gain to the quantized LPC gain according to the update formula:

$$RMS_{res} = RMS_{res}\sqrt{\frac{LPCG_{UQ}}{LPCG_Q}}$$

where the LPC gain is given by:

$$LPCG = \frac{1}{\pi(1 - rc_i^2)}$$

and where $rc_i$ are the reflection coefficients.

The compensated gain is provided to gain quantizer 43 for quantization of the compensated gain value. In one embodiment of the present invention, gain quantizer 43 codes the compensated gain value with a 5 bit Lloyd-Max scalar quantizer to generate gain index signal 4. This technique consumes 5 bits/20 msec, or 250 bits/sec of the total coder rate.

Voicing cut off frequency analyzer and encoder 60 is of particular significance to the principles and concepts embodied by the speech coding system of the present invention. As best shown in FIG. 3, voicing cut off frequency analyzer 60 comprises, as major components, voicing cut off frequency estimator 61 and voicing cut off frequency quantizer 62. As shown in FIG. 4, voicing cut off frequency analyzer 60 further comprises: full wave rectifier 63, highpass filter 64 and pitch-lag correlator 65.

The term voicing cut off frequency is used herein to describe a single transition frequency below which voiced excitation is present in a frame of the input speech waveform, and above which unvoiced excitation is present in the input speech waveform. As will be recognized by those skilled in the art, quantizing this voicing cut off frequency may be accomplished in a number of different ways.

Prior art speech coding systems, such as MBE-style (Multi Band Excitation) vocoders, make separate voicing decision for several bands. This prior art technique can require up to 11 bits for quantization. In contrast, one embodiment of the present invention employs 6 to 8 equally spaced frequencies for quantization. Thus, a total of 3 bits are required for transmission. The apparatus and method of the present invention requires fewer bits than prior art MELP style coders, which require 4 (bandpass voicing)+1 (overall voicing)=5 bits (for a 4 band system).

In the current 2000 and 1500 bit per second embodiments of the present invention there are eight cutoff frequencies: 0, 571, 1143, 1714, 2286, 2857, 3249, and 4000 Hz. The 0 and 4000 Hz frequencies correspond to fully voiced and fully unvoiced modes, respectively.

The voicing cutoff frequency is determined using a 7 band, bandpass filter 61. Bandpass filter 61 is implemented with a bank of 65 tap FIR filters of hamming window design, with 6 dB points at the cutoff frequencies. Speech input signal 1 is filtered through bandpass filter 61, producing 7 bandpass signals at the output of bandpass filter 61. These seven bandpass signals are provided to full wave rectifier means 63 where they are rectified, lowpass filtered, and finally provided to highpass filter 64. Highpass filter 64 operates as a highpass filter for DC removal. Highpass filter 64 may comprise a second-order Butterworth filter with a cut off frequency of 100 Hz. The use of a pole-zero filter for DC removal ensures effective performance of the coder of the present invention.

The filtered, rectified, bandpass signals are then provided to pitch-lag correlator 65. Pitch lag correlator 65 performs a dual-normalized autocorrelation search of the bandpass signals. The search may be performed with lags +/−10% around smoothed pitch value 150 provided by pitch analyzer 51. The peak autocorrelation value for each band is saved in a memory array for subsequent cutoff frequency determination.

In one embodiment of the present invention, the voicing cutoff frequency is represented by a 3 bit number fsel The number fsel may take values between 0 and 7, with fsel-0 representing 0 Hz, fsel-1 representing 571 Hz, on up to fsel-7 representing 4000 Hz. The number fsel is determined by the values of the array of dual-normalized peak autocorrelation values described above. The array is indexed from 0 to 7, with 0 corresponding to the 0–571 Hz band, and 7 corresponding to the 3259–4000 Hz band. A search is performed over the autocorrelation array, and any band having a correlation greater than 0.6 is marked as voiced. The voicing array is then smoothed such that an unvoiced band is marked voiced if lies between two voiced bands. In addition, band 0 may be marked voiced if band 1 is voiced. The following is an example of FORTRAN code which implements a voicing cut off frequency quantization algorithm in a single pass:

EXAMPLE 1

```
c determine fsel (voicing cutoff)
      itmp = 0
      fsel = 0
      do i = 0,6
      fsel = fsel + 1
      if (cor (i) .lt. 0.6) then
        itmp = itmp + 1
        if (itmp .ge. 2) then
          fsel = fsel - 2
          goto 400
        end if
        if (i.eq.6) fsel = 6
      else
        itmp = 0
      end if
    end do
400 continue
```

Because of occasional irregularities in the periodicity of voiced speech, some smoothing of the fsel parameter may be desirable. The following segment of FORTRAN code illustrates an example of an algorithm which may be used in the present invention for smoothing the fsel parameter.

EXAMPLE 2

Defining the variables in the segment:

```
fsel          current frame's voicing cutoff (0–7)
fsellast      last frame's voicing cutoff (0–7)
rmsi_fb(-1)   last frame's input rms
rmsi_fb(0)    current frame's input rms
rmsi_fb(1)    future frame's input rms
zc(0)         current frame's zero crossing count
Ipcg1         current frames unquantized LPC gain
braw(0)       current frame's full band dual-normalized
              autocorrelation at the pitch lag
  if ((fsel .le. 1) .and. (rmsi_fb(-1) .le. 100.0) .and.
1   (rmsi_fb (1) .ge. 1000.0) ) then
  else if ((fsel .eq.0) .and. (rmsi_fb(0) .ge. 200.0) .and.
1   (zc(0) .le. 40) .and. (braw (0) .ge. 0.9) ) then
  fsel = max (fsellast, nint (7.0*(1.0 - float (zc(0)/80.0)))
    else if ((fsel .eq.0) .and. (rmsi_fb(0) .ge. 1800.0) .and.
1   (zc(0) .le. 40)) then
      fsel = max (fsellast, nint (7.0*(1.0 - float (zc(0)/80.0)))
    else if ((fsel .eq.0) .and. (rmsi_fb(0) .ge. 1000.0) .and.
1   (zc(0) .le. 20) .and. (Ipcg1 .ge. 40.0)) then
      fsel = max (fsellast, nint (7.0*(1.0 - float (zc(0)/80.0)))
    end if
```

The first case represents a plosive onset ('b' or 'p' type sound), so the fsel value is not changed from its low input value. The second case allows for an increase in fsel if there is very high full band autocorrelation. The third case allows an increase if there is a very high signal level and moderate zero crossing rate. Finally, the last case allows an increase if the signal level is moderately high, the zero crossing rate very low and the LPC gain moderately high.

As stated above, fsel is quantized with 3 bits, which contribute 3 bits/20 msec, or 150 bits/sec, to the overall transmission rate.

Table 1 shows two example bit allocations, one for a 1500 b/sec embodiment of the present invention and one for a 2000 b/sec embodiment of the present invention.

TABLE 1

| Encoder | b/sec = 2000 | | b/sec = 1500 | |
|---|---|---|---|---|
| Parameter | bits | rate | bits | rate |
| LSF Spectrum | 26 | 1300 | 32/40 msec | 800 |
| Pitch | 6 | 300 | 6 | 300 |
| Voicing Cutoff | 3 | 150 | 3 | 150 |
| Gain | 5 | 250 | 5 | 250 |

Pitch analyzer 50 comprises low pass filter 52 and pitch analyzer unit 51. Low pass filter 52 receives speech input signal 1 and preprocesses it to remove high frequency components. Low pass filter 52 provides a filtered speech signal to pitch analyzer unit 51. While one embodiment of the present invention employs known average magnitude difference function (AMDF) algorithms to provide multi-frame smoothed pitch tracking, any multi-frame smoothed pitch tracking technique may be employed in the present invention. Multiple frames may be tracked to smooth out occasional pitch doublings. In addition, the tracker portion of pitch analyzer unit 51 may be adapted to return a fixed value (last valid pitch, or any fixed value that is unrelated to the lag associated with peak auto correlation) during unvoiced speech. This technique has been shown to minimize false-positive voicing decisions in the voicing cutoff logic.

The quantized pitch value of speech input signal 1 is provided to pitch-lag correlator 65. In addition, the quantized value is coded with a 6 bit logarithmically spaced table with lags between 60 and 118 samples, to produce pitch index signal 8. The table is similar to that used in the FS-1015 (Federal Standard LPC-10 vocoder). Pitch index signal 8 is provided by pitch analyzer 51 to multiplexer 16.

Decoder 20

Figure 5:
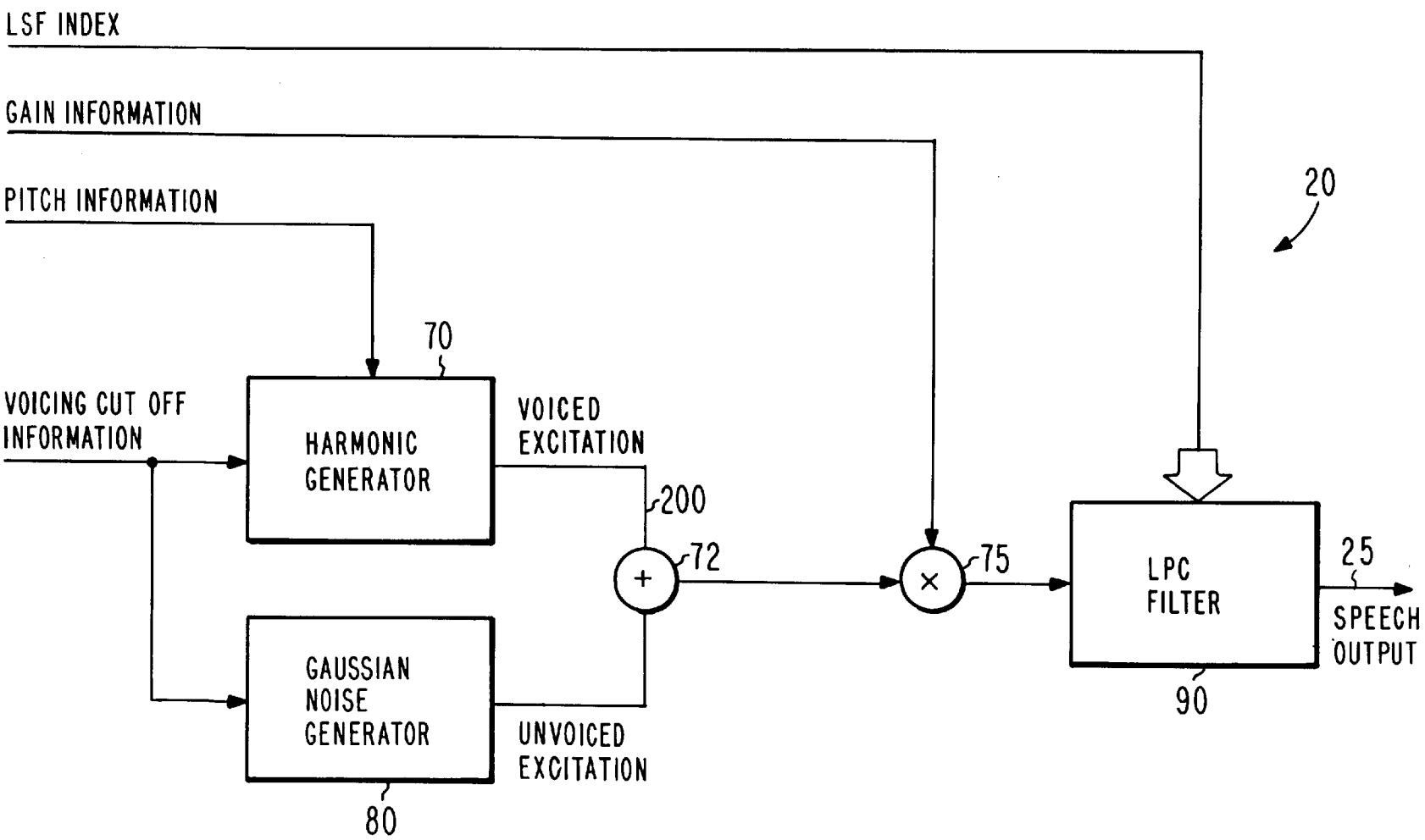
FIG. 5 is a block diagram of major components of the decoding subsystem of the speech coding system shown in FIG. 1 according to one embodiment of the present invention.

A block diagram of speech decoder 20 is shown in FIG. 5. Decoder 20 comprises three major components: harmonic generator 70, also referred to herein as pitch epoch generator 70, Gaussian noise generator 80 and LPC synthesis filter 90. Harmonic generator 70 generates a pulse train corresponding to voiced sounds and Gaussian noise generator 80 generates random noise corresponding to unvoiced sounds. Pitch information derived from pitch index signal 6, which includes pitch period information, is supplied to harmonic generator 70 to generate the proper pitch or frequency of the voiced excitation corresponding to the frame of speech being decoded.

One embodiment of the present invention uses voicing cut-off frequency information derived from the fsel signal to control the operation of both harmonic generator 70 and Gaussian noise generator 80. The Gaussian noise output from the Gaussian noise generator provides the unvoiced excitation for LPC synthesis filter 90. The output of pitch epoch generator 70 provides the voiced excitation for LPC synthesis filter 90. The Gaussian noise output is combined with the impulse train output of pitch epoch generator 70 at adder 72. The output of adder 72 is provided to multiplier 75. Multiplier 75 modulates the amplitude of the combined output in accordance with gain information derived from gain index signal 4. The output of multiplier 75 is provided to LPC filter 90. LPC Filter 90 shapes the output of multiplier 5 in accordance with the LSF coefficients information derived from LSF index signal 2 to produce synthesized speech signal 25.

Figure 6:
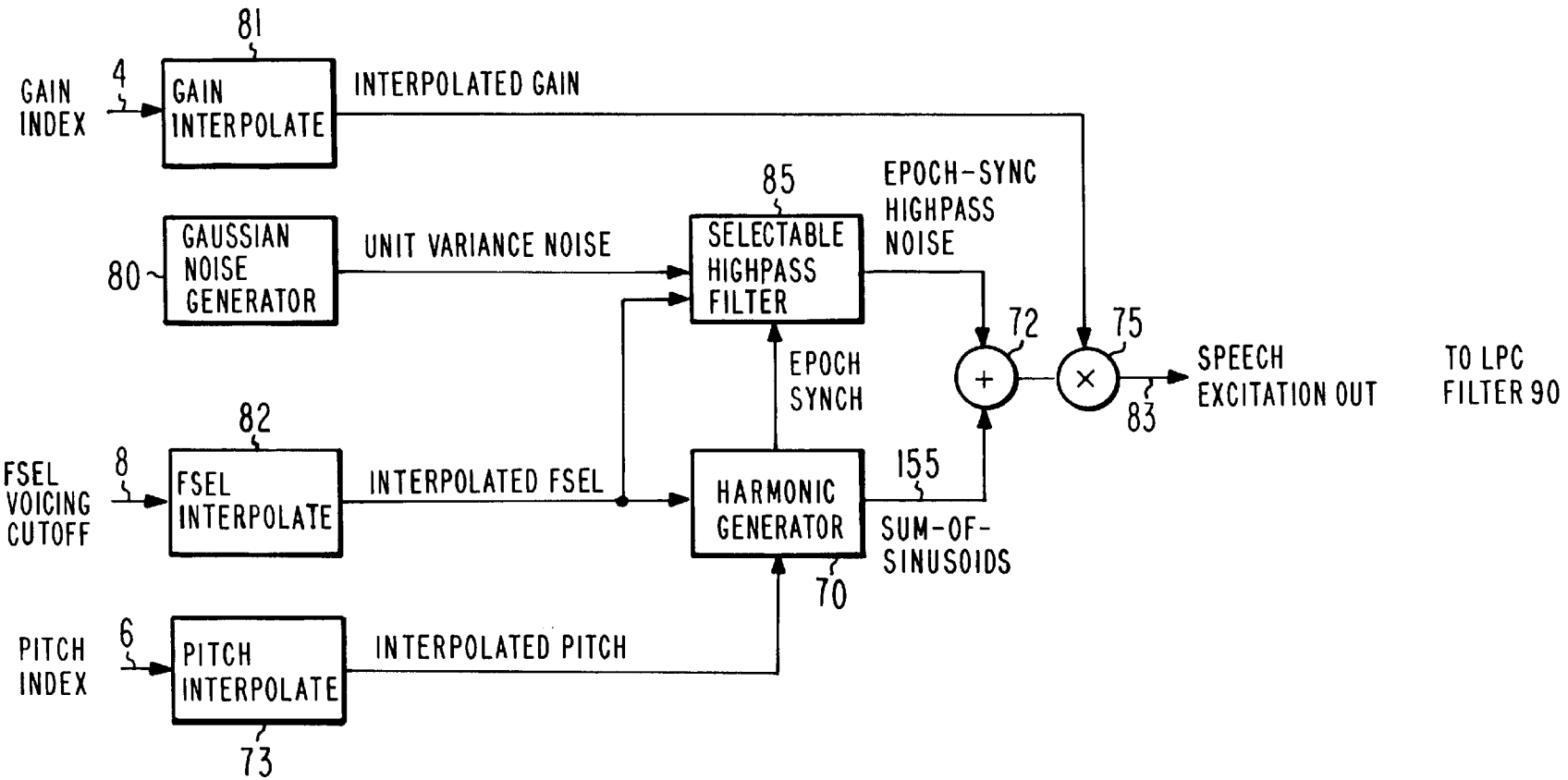
FIG. 6 is a more detailed block diagram of the decoding subsystem shown in FIG. 5.

FIG. 6 shows a more detailed block diagram of speech decoder 20. The system and method of the present invention as it relates to generation of the voiced excitation (pitch epoch generator) and the unvoiced excitation (Gaussian noise generator and selectable highpass filter) will now be discussed in greater detail.

Harmonic generator 70 provides voiced excitation one pitch epoch at a time. A pitch epoch is a single period of the voiced excitation. A single frame of speech may comprise a plurality of epochs. During an epoch, all the parameters of the excitation are held constant; the pitch period (length of the epoch), the fundamental frequency of the excitation, and the voicing cutoff frequency (fsel). The parameter values are determined at the beginning of the epoch by interpolating current and previous frames' parameter values according to the time position of the epoch in the frame of voiced speech being synthesized. Epochs located close to the beginning of a frame have interpolated values closer to the previous frame's values, while epochs near the end are closer to the current frame's values. Although this interpolation introduces a half-frame delay in the synthesized speech, it produces the highest quality output.

Since the pitch period and fsel voicing cutoff frequency are integer numbers, they may be first interpolated in floating point and then set to the nearest integer value. Voiced excitation is built up by summing harmonics of the fundamental frequency up to the voicing cutoff frequency. The number of harmonics (nh) is given by:

$$\left(\frac{fsel}{7.0}\right)\left(\frac{4000.0}{f_0}\right) \tag{1}$$

where $f_0$ is the fundamental frequency. The voiced excitation is given by $$epoch(i) = \sqrt{\frac{2}{nh}} \sum_{j=1}^{nh} a(j)\cos(w_0 ij + phase(j)) \tag{2}$$

$$\text{for } i = 0 \ldots pitch - 1 \quad \text{and} \quad nh > 0$$

where epoch(i) is the i-th sample of the voiced excitation, nh is the number of harmonics, pitch is the fundamental pitch period given in number of samples, $w_0$ is the digital fundamental frequency ($2\pi f_0/8000$), a(j) is the amplitude of the j-th harmonic, and phase(j) is the adaptive phase offset for the j-th harmonic. The phase terms are calculated by methods disclosed in related application Ser. No. 09/114,663, filed on even date herewith.

Prior art methods include sum-of-sinusoid methods of generating voiced excitation, such as Multiband Excitation (MBE) and Sinusoidal Transform (ST) coder techniques. The method of the present invention provides the advantage of instantaneous renormalization of the sum in Equation (2) whenever a harmonic is added or deleted, and also provides fixed frequency and phase for the entire pitch epoch. Thus, the methods of the present invention require no complex "birth" or "death" algorithms for adding or deleting sinusoids in the sum. Informal listening tests of predictive coders show that the use of the method of the present invention gives a better perceptual spectral depth than prior art methods.

Unvoiced excitation is generated by using selectable second highpass filter 85 cascaded with a zero-mean, unit variance Gaussian noise generator 80. The passband of selectable second high pass filter 85 is selected by the fsel parameter as follows: fsel values 0 through 7 select highpass cutoff frequencies of: 0, 571, 1143, 1714, 2286, 2857, 3249, and 4000 Hz, respectively. Use of these frequencies and the nh value from Equation (1) ensure that there is no overlap between the voiced and unvoiced excitation.

The full band excitation is generated by summing the voiced and unvoiced excitation. The sum (shown at 155) will have a unit variance because of the normalization factor in Equation (2) and the fact that the RMS level of the highpass filtered Gaussian sequence is given by $$\sqrt{\frac{(7 - fsel)}{7}}$$

For this reason, a single gain (based on the input signal's residual RMS) is used in one embodiment of the predictive style speech coder of the present invention. This technique offers a significant bit rate savings over a dual (voiced and unvoiced) gain system.

In one embodiment of the present invention, excitation parameters may be interpolated 4 times per frame, resulting in 4 "subframes" during which the excitation parameter values are held constant. However, a pitch epoch can be longer than a subframe. In this case, the voiced excitation parameters are not switched at the subframe boundary, but held constant until the end of the epoch. The unvoiced parameters may also be switched in an epoch-synchronous fashion for the best performance.

Detailed Description—Decoder

Figure 7:
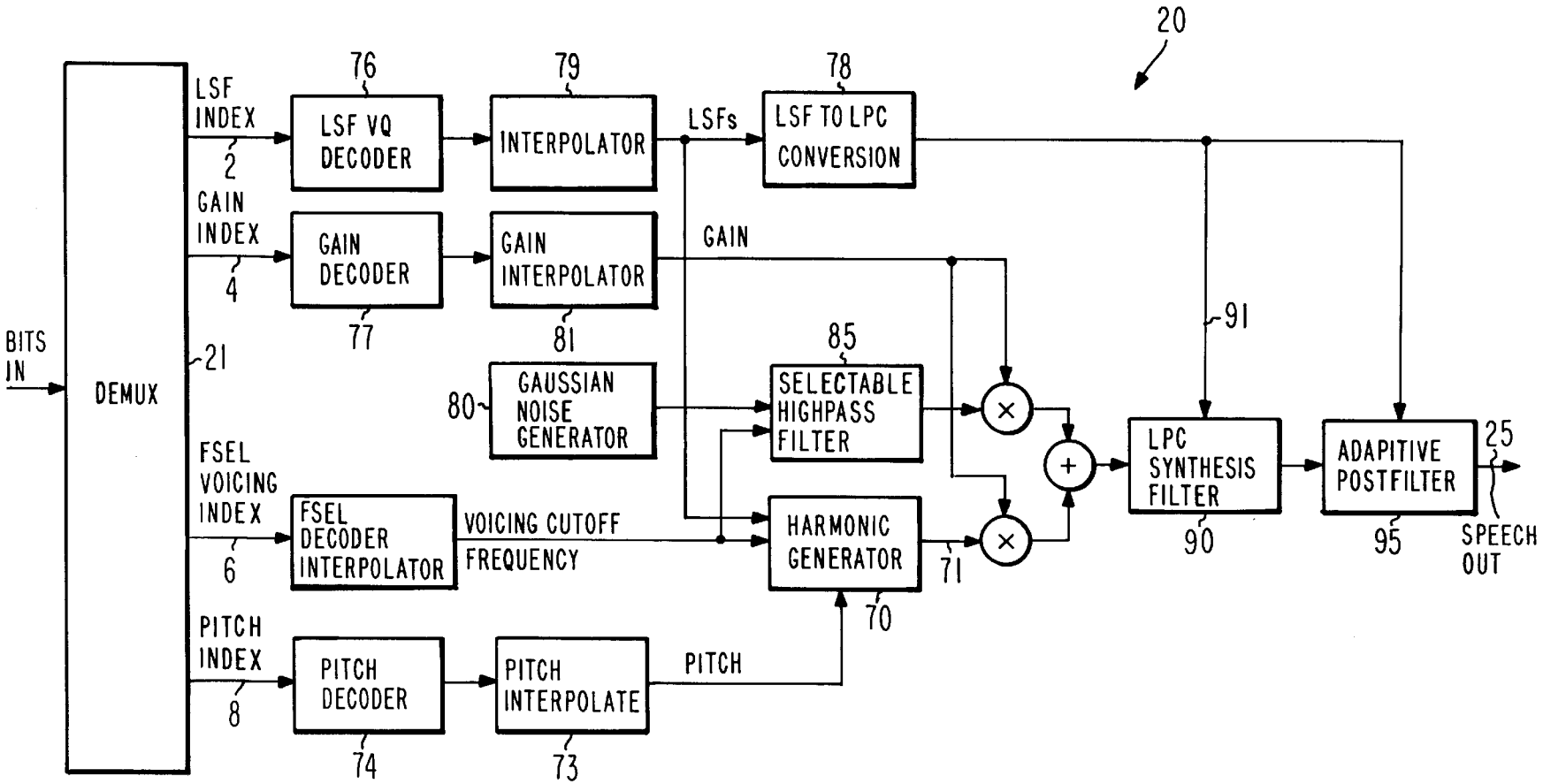
FIG. 7 is a more detailed block diagram of the decoding subsystem shown in FIG. 6 according to one embodiment of the present invention.

Turning now to FIG. 7, there is shown a detailed block diagram of speech decoder 20 according to one embodiment of the present invention. As illustrated in FIG. 7, received quantization indices 2,4,6 and 8 are decoded and interpolated by their respective decoders and interpolators. All quantization indices are decoded and interpreted over a frame of speech to be synthesized. In one embodiment of the present invention, interpolation is linear, performed 4 times per frame, and uses weighted combinations of the current frame's parameters and the previous frame's values. Since the pitch and voicing cutoff values are integer, their interpolations are first performed in floating point, and may then be converted to the nearest integer.

The gain parameter is preferably treated somewhat differently than the other parameters. If the gain rapidly decreases (current gain is less than one tenth of the previous gain), the previous frame's input to gain interpolator 81 is replaced with one tenth of the original value. This allows for fast decay at the end of a word and reduces perceived echo.

As previously described, voiced excitation is generated by summing lowpass periodic excitation produced by harmonic generator 70 and high pass Gaussian noise produced by Gaussian noise generator 80 cascaded with selectable second highpass filter 85. Another method for reducing perceptual buzziness of synthesized speech according to the teachings of the present invention is to enhance spectral formant characteristics of the synthesized speech signal.

As shown in FIG. 7, voiced speech excitation is provided by harmonic epoch generator 70 is given by:

$$epoch(i) = \sqrt{\frac{2}{nh}} \sum_{k=1}^{nh} amp(k)\cos(w_0 ik + phase(k)) \tag{2a}$$

$$\text{for } i = 0 \ldots pitch - 1 \quad \text{and} \quad nh > 0$$

where epoch(i) is the i-th sample of the voiced excitation, nh is the number of harmonics, pitch is the fundamental pitch period in samples, $w_0$ is the digital fundamental frequency ($2\pi f_0/8000$), amp(k) is the amplitude of the k-th harmonic, and phase (k) is the adaptive phase offset for the k-th harmonic.

According to one embodiment of the present invention a harmonic generator method and apparatus are provided for computation of the amplitude set [amp(k)] such that the perceptual buzziness of the output speech is minimized. This technique, referred to herein as formant enhancement, includes a step of attenuating the amplitude values in spectral valleys of the synthesized speech spectrum. As a result of this attenuation, the output speech is perceived to have greater spectral depth and less buzziness. Hence, the definition of spectral valleys and peak are keys to performance of the algorithm of the present invention.

In alternate embodiments of the present invention, all values of the set [amp(k)] are set equal to 1.0. However, this tends to produce a spectrally flat excitation, similar to that produced in a LPC-10 (Federal Standard 1015) speech decoder. Perceptual evaluation has revealed that attenuation of the amplitude values in spectral valleys leads to less buzziness and greater perceived spectral depth in the output speech.

In a predictive speech coder according to an embodiment of the present invention, the spectrum of the speech is transmitted by autoregressive LPC synthesis filter 90 is represented by LPC coefficients as indicated at 91 in FIG. 7., and denoted herein by a(0) . . . a(m+1), where m is the order of the LPC model and a(0)=1.0. When LPC coefficients 91 are used in an all-pole filter, such as LPC synthesis filter 90, the filter 90 has a transfer function that approximates (in the least square error sense) the gross spectrum of the input speech. It is from LPC coefficients 91 that the spectral peaks and valleys are derived according to the method of the present invention.

First, the spectral peaks are be determined from LPC coefficients 91 by using any of several algorithms. According to one embodiment of the present invention the LPC polynomial is factored into its real and imaginary roots and determine the resonant frequencies according to the formula:

$$rfreq(i) = \frac{8000.0 \tan^{-1}\left(\frac{ri(i)}{rr(i)}\right)}{2\pi} \quad \text{for } i = 1 \ldots m \tag{3}$$

where rfreq(i) is the i-th resonant frequency in Hz (for an 8 kHz sampled system), ri(i) is the i-th imaginary root, rr(i) is the i-th real root, and m is the LPC order. There can be up to m/2 complex frequency pairs (a pair consisting of positive and negative values of the same frequency), or a lower number of complex pairs plus frequencies at 0 Hz and one half the sampling frequency.

Another method for finding the peak frequencies is to construct the amplitude spectrum from the LPC coefficients using the formula:

$$H(w) = \left| \frac{1}{\sum_{i=0}^{m} a(i) e^{ijw}} \right| \tag{4}$$

where H(w) is the amplitude at frequency w,w is the digital frequency 2πfl8000, a(i) are the LPC coefficients, and $j=\sqrt{-1}$. The next step is to search for the local peak values of H(w) which will yield a set of peaks usable in the spectral formant enhancement algorithm of the present invention.

After peak frequencies have been determined using the previous method, the frequencies of the peak values (in array rfreq( )) are sorted and ordered from lowest to highest frequency in an array sfreq( ). The number of peaks is stored in variable np.

After the frequencies of the peak values (in array rfreq( )) are sorted, Equation (4) is used to find the amplitudes that would result at the harmonics of the fundamental pitch frequency $w_0$ from LPC synthesis filter 90. These values are stored in an array ampsav:

$$ampsav(k) = \left| \frac{1}{\sum_{i=0}^{m} a(i) e^{ijw_0 k}} \right| \quad \text{for } k = 1 \ldots nh \tag{5}$$

where k is the harmonic number, $kw_0$ is the two digital harmonic frequency [0–π], and $kf_0$=8000 kwo/2π [0–4000 Hz] is the analog harmonic frequency (used below). The array ampsav( ) is then stepped through one harmonic at a time (k ranging from 1 to nh) to determine each value of amp( ) needed in Equation (2a).

The formant enhancement method of the present invention comprises the following steps:

1. Determine the resonance frequency nearest to the current harmonic frequency ($kf_0$). This is the primary resonance frequency, denoted by $f_{pr}$.

2. Get the peak harmonic amplitude from ampsav( ) nearest in frequency to the primary resonance frequency found in step (1). Save this amplitude value in variables tmp and peak.

3. Determine if the current harmonic frequency is between two resonance frequencies or between a single resonance frequency and 0 or 4000 Hz. If it is not between two resonance frequencies, skip to step (7).

4. Find the secondary resonance frequency. The secondary resonance is defined by: A) If the current harmonic frequency is greater than the primary resonance, then the secondary resonance is the next resonance frequency immediately above the primary resonance frequency; or B) If the current harmonic frequency is less than the primary resonance frequency, then the secondary resonance frequency is the previous resonance frequency immediately below the primary resonance frequency. The secondary resonance frequency is denoted by $f_{sr}$.

5. Find the peak harmonic amplitude ampsav( ) nearest in frequency to the secondary resonance frequency found in step (4). Save this amplitude value in variable tmp2.

6. Compute a weighted average of the peak amplitudes tmp and tmp2, based on the distance between the current harmonic frequency, primary resonance frequency, and secondary resonance frequency:

$$peak = tmp\left|\frac{kf_0 - f_{sr}}{f_{pr} - f_{sr}}\right| + tmp2\left|\frac{kf_0 - f_{pr}}{f_{pr} - f_{sr}}\right| \tag{6}$$

7. Compute the values of ampsav(k) and peak. If ampsav (k) is equal to or greater than peak, set amp(k)=1.0. Otherwise set $$amp(k) = \left[\frac{ampsav(k)}{peak}\right]^{0.35} \tag{7}$$

8. It is often desirable not to attenuate amplitudes below the first resonance frequency. Setting amp(k)=1.0 in this range will improve the perceptual bass performance.

9. Return to step (1) and repeat until all harmonic amplitudes have been generated.

To generate unvoiced excitation, Gaussian noise generator 80 provides unit variance noise to selectable highpass filter 85 to generate unvoiced excitation in the form of epoch synchronized highpass noise. In one embodiment of the present invention, selectable high pass filter 85 comprises 65 tap linear phase hamming window designs. The filter taps may be changed up to 4 times per frame, concurrent with interpolation updates. If an fsel value of seven is received (indicating completely voiced excitation) Gaussian generator 80 continues to run, and the memory (not shown) of filter 85 is updated with noise samples, but no filtering is performed, nor output generated. This technique minimizes discontinuities in the signal provided to the LPC synthesis filter 90.

LPC synthesis filter 90 and adaptive postfilter 95 are similar to those used in FS-1016 (Federal standard 4.8 kb/sec CELP) coders. The LPC filter coefficients used by both are interpolated 4 times per frame in the LSF domain. However, according to the teachings of the present invention, adaptive postfilter 95 may be modified from the FS-1016 version, to include an additional FIR high frequency boosting filter. This has been found to increase the "crispness" of the output speech.

Therefore, a system and method for speech coding with increased perceptual quality and minimized bit rate is shown and described. Although the method and apparatus of the present invention has been described in connection with a preferred embodiment, it is not intended to be limited to the specific form set forth herein. On the contrary, it is intended to cover such alternatives, and equivalents, as can be reasonably included within the spirit and scope of the invention as defined by the appended claims.

We claim:

1. A method for synthesizing speech comprising the steps of:

determining spectral peaks and valleys of a synthesized speech spectrum;

attenuating the amplitude values in the spectral valleys of said synthesized speech spectrum without attenuating said spectral peaks.

2. A speech synthesizer comprising:

a linear predictive coefficient (LPC) filter adapted to provide a synthesized speech waveform including voiced portions at an output in response to voiced speech excitation at an input;

a harmonic generator for providing voiced speech excitation comprising spectral peaks and valleys to said input of said LPC filter; said voiced speech excitation characterized by the relationship:

$$epoch(i) = \sqrt{\frac{2}{nh}} \sum_{k=1}^{nh} amp(k)\cos(w_0 ik + phase(k))$$

$$\text{for } i = 0 \ldots pitch - 1 \quad \text{and} \quad nh > 0$$

wherein said harmonic generator is adapted to attenuate values of amp (k) in said spectral valleys.

* * * * *